US008074558B2

(12) United States Patent
Knussman et al.

(10) Patent No.: US 8,074,558 B2
(45) Date of Patent: Dec. 13, 2011

(54) AXIAL PISTON DEVICE HAVING ROTARY DISPLACEMENT CONTROL

(75) Inventors: Michael L. Knussman, East Peoria, IL (US); William Edward Frank, Peoria, IL (US); Cory Lynn Fisher, Bradford, IL (US)

(73) Assignee: Caterpillar Inc., Peoria, IL (US)

( * ) Notice: Subject to any disclaimer, the term of this patent is extended or adjusted under 35 U.S.C. 154(b) by 680 days.

(21) Appl. No.: 12/149,327

(22) Filed: Apr. 30, 2008

(65) Prior Publication Data

US 2009/0272256 A1 Nov. 5, 2009

(51) Int. Cl.
*F04B 49/12* (2006.01)
*F04B 1/12* (2006.01)

(52) U.S. Cl. ..... 92/12.2

(58) Field of Classification Search ..... 92/12.1, 92/12.2, 13; 91/368, 505
See application file for complete search history.

(56) References Cited

U.S. PATENT DOCUMENTS

| | | | | |
|---|---|---|---|---|
| 123,174 | A | 1/1872 | Hopkins | |
| 3,106,224 | A | 10/1963 | Moss et al. | |
| 3,548,876 | A | 12/1970 | Viersma et al. | |
| 3,631,763 | A | 1/1972 | Court | |
| 3,665,807 | A | 5/1972 | Bartholomäus et al. | |
| 3,722,769 | A | 3/1973 | Aplet et al. | |
| 3,812,765 | A * | 5/1974 | Himmler | 91/506 |
| 4,205,590 | A | 6/1980 | Stegner | |
| 4,245,547 | A | 1/1981 | Reynolds | |
| 4,262,969 | A | 4/1981 | Chatterjea | |
| RE31,657 | E | 9/1984 | Caruso | |
| 4,545,409 | A | 10/1985 | Luhmer | |
| 4,674,539 | A | 6/1987 | Sloate | |
| 4,683,915 | A | 8/1987 | Sloate | |
| 4,766,926 | A | 8/1988 | Smith | |
| 4,779,648 | A | 10/1988 | Sloate | |
| 4,803,415 | A | 2/1989 | Sepesy | |
| 4,887,632 | A | 12/1989 | Tanaka et al. | |

(Continued)

FOREIGN PATENT DOCUMENTS

EP 0 088 017 A2 9/1983

(Continued)

OTHER PUBLICATIONS

Philippe G. Vande Kerckhove et al., U.S. Appl. No. 11/643,818 entitled "Rotary-Actuated Electro-Hydraulic Valve" filed Dec. 22, 2006.

(Continued)

*Primary Examiner* — Thomas E Lazo
(74) *Attorney, Agent, or Firm* — Finnegan, Henderson, Farabow, Garrett & Dunner LLP

(57) ABSTRACT

An axial piston device for use with a hydraulic system is disclosed. The axial piston device may have a body defining at least one bore and having a central axis, a pump piston disposed within the at least one bore to at least partially define a pumping chamber, and a tiltable plate biased into engagement with the pump piston. The axial piston device may also have an actuator configured to selective tilt the plate relative to the central axis of the body to thereby vary a displacement of the pump piston within the at least one bore. The actuator may have a control piston operatively connected to move the tiltable plate, a rotary motor, and a valve driven by the rotary motor to control fluid communication between the control piston and a source of pressurized fluid to move the control piston.

19 Claims, 2 Drawing Sheets

U.S. PATENT DOCUMENTS

| | | | | |
|---|---|---|---|---|
| 4,901,529 | A | 2/1990 | Iino et al. | |
| 4,974,994 | A | 12/1990 | Kirstein et al. | |
| 5,440,878 | A | 8/1995 | Gleasman et al. | |
| 5,490,383 | A | 2/1996 | Müller et al. | |
| 5,881,629 | A * | 3/1999 | Gollner et al. | 91/505 |
| 6,048,176 | A * | 4/2000 | Deininger | 92/12.2 |
| 6,155,798 | A * | 12/2000 | Deininger et al. | 92/12.2 |
| 6,283,721 | B1 * | 9/2001 | Gollner | 92/12.2 |
| 6,374,722 | B1 | 4/2002 | Du et al. | |
| 6,553,891 | B2 * | 4/2003 | Fiebing et al. | 92/12.2 |
| 6,637,461 | B2 | 10/2003 | Post | |
| 6,834,736 | B2 | 12/2004 | Kramer et al. | |
| 6,874,994 | B2 | 4/2005 | Folsom et al. | |
| 6,951,164 | B2 | 10/2005 | Ito et al. | |
| 7,076,948 | B2 | 7/2006 | Ito et al. | |
| 7,735,517 | B2 | 6/2010 | Kerckhove et al. | |

FOREIGN PATENT DOCUMENTS

| | | | |
|---|---|---|---|
| JP | 63-001802 | A | 1/1988 |
| JP | 50-17970 | A | 1/1993 |
| JP | 62-41207 | A | 8/1994 |
| JP | 2003/278703 | A | 10/2003 |

OTHER PUBLICATIONS

English-language Abstract of EP 0 088 017 A2, Sep. 7, 1983.
English-language Abstract of JP 63-001802 A, Jan. 6, 1988.
English-language Abstract of JP 50-17970 A, Jan. 26, 1993.
English-language Abstract of JP 62-41207 A, Aug. 30, 1994.
English-language Abstract of JP 2003/278703 A, Oct. 2, 2003.

* cited by examiner

AXIAL PISTON DEVICE HAVING ROTARY DISPLACEMENT CONTROL

TECHNICAL FIELD

The present disclosure is directed to an axial piston device and, more particularly, to an axial piston device having rotary displacement control.

BACKGROUND

Variable displacement pumps generally include a plurality of pistons held against the driving surface of a tiltable swashplate. A joint such as a ball and socket joint is disposed between each piston and the swashplate to allow for relative movement between the swashplate and the pistons. Each piston is slidably disposed to reciprocate within an associated barrel as the pistons rotate relative to the tilted surface of the swashplate. As each piston is retracted from the associated barrel, low pressure fluid is drawn into that barrel. When the piston is forced back into the barrel by the driving surface of the swashplate, the piston pushes the fluid from the barrel at an elevated pressure.

The tilt angle of the swashplate is directly related to an amount of fluid pushed from each barrel during a single relative rotation between the pistons and the swashplate. And, based on a restriction of the pump and/or a fluid circuit connected to the pump, the amount of fluid pushed from the barrel during each rotation is directly related to the flow rate and pressure of fluid exiting the pump. Thus, a higher tilt angle equates to a greater flow rate and pressure, while a lower tilt angle results in a lower flow rate and pressure. Similarly, a higher tilt angle requires more power from a driving source to produce the higher flow rates and pressures than does a lower tilt angle. As such, when the demand for fluid is low, the swashplate angle is typically reduced to lower the power consumption of the pump.

Some variable displacement pumps utilize a hydraulic piston to adjust the tilt angle of the swashplate. The hydraulic piston is connected to the swashplate and moved by an imbalance of forces on the hydraulic piston. As the hydraulic piston is moved to retract or extend, the tilt angle of the swashplate is increased or decreased. Movement of the hydraulic piston is generally controlled by way of a pilot or solenoid activated linear spool valve. Unfortunately, linear spool valves may lack accuracy in their control over movement of the hydraulic piston.

One attempt at improving control accuracy of the hydraulic piston is described in U.S. Pat. No. 4,205,590 (the '590 patent) issued to Stegner on Jun. 3, 1980. The '590 patent discloses a pump having a stationary housing surrounding a rotatable cylinder block adapted to be rotated by a shaft. The block has a pair of pump pistons arranged against a swashplate on opposite sides of the shaft. A fluid actuator is provided to control displacement of the pump pistons, and includes a first control piston and a second control piston linked to the swashplate. By regulating a flow of fluid to the control pistons, the control pistons can pivot the swashplate and thereby control a stroke length of each of the pump pistons.

The pump of the '590 patent also includes a lobed cylindrical valve spool, and a sleeve member that receives the valve spool. A polarized torque motor is connected to linearly move the valve spool relative to the sleeve by way of a flapper. When the flapper is moved by the motor in a first direction, the valve spool is urged to communicate pressurized fluid with the first control piston and drain the second control piston of fluid, thereby tilting the swashplate to increase a displacement of the pump pistons. When the flapper is moved by the motor in a second direction, the valve spool is urged to communicate pressurized fluid with the second control piston and drain the first control piston of fluid, thereby tilting the swashplate to decrease a displacement of the pump pistons. A return spring is situated to return the flapper to a neutral position. In this configuration, a force applied by the motor to the flapper will move the valve spool until a resistance of the return spring balances the force of the motor.

An articulated feedback mechanism is connected between the swashplate and the sleeve member of the '590 patent. As the swashplate tilts, the articulated feedback mechanism pivots and transfers the tilting motion to a linear motion of the sleeve member relative to the spool valve. When a desired angle of the swashplate is achieved, the sleeve member is sufficiently moved by the tilting motion to block fluid flow through the valve spool so as to maintain the desired angle.

In the pump configuration of the '590 patent, a change in current input to the torque motor will produce a proportional change in the valve spool position. A change in valve spool position will produce a change in the positions of the pump pistons, thereby changing the angularity of the swashplate about its tilt axis. The feedback mechanism moves through the same angle as the swashplate and, by its articulated connection with the sleeve member, slaves the sleeve member on the valve spool. Thus, a current applied to the motor will be proportional to a displacement of the pump.

Although the pump of the '590 patent may improve displacement control accuracy, it may still be limited. Specifically, the pump relies on precise control over the current applied to the motor in order to ensure displacement accuracy. If the applied current varies, the actual displacement may not match a desired displacement. And, as the components of the pump age or the pump is used in varying environments and for different applications, precise control over the current may be difficult to ensure. In addition, the flapper configuration may have low durability and responsiveness. Further, the linear translation of the valve spool may create dynamic fluid interactions that could reduce displacement accuracy of the pump.

The axial piston device of the present disclosure solves one or more of the problems set forth above and/or other problems.

SUMMARY OF THE INVENTION

One aspect of the present disclosure is directed to an axial piston device. The axial piston device may include a body defining at least one bore and having a central axis, a pump piston disposed within the at least one bore to at least partially define a pumping chamber, and a tiltable plate biased into engagement with the pump piston. The axial piston device may also include an actuator configured to selective tilt the plate relative to the central axis of the body to thereby vary a displacement of the pump piston within the at least one bore. The actuator may include a control piston operatively connected to move the tiltable plate, a rotary motor, and a valve driven by the rotary motor to control fluid communication between the control piston and a source of pressurized fluid to move the control piston.

Another aspect of the present disclosure is directed to a method of converting power. The method may include directing fluid into a pumping chamber, and mechanically reducing a volume of the pumping chamber to pressurize and expel the fluid from the pumping chamber. The method may further include rotating a valve element to hydraulically adjust an amount of mechanical reduction.

Yet another aspect of the present disclosure is directed to another method of converting power. This method may include directing pressurized fluid into a pumping chamber, and expanding the pressurized fluid within the pumping chamber to generate a mechanical output. The method may further include rotating a valve element to hydraulically adjust an amount of expansion.

DETAILED DESCRIPTION

Figure 1:
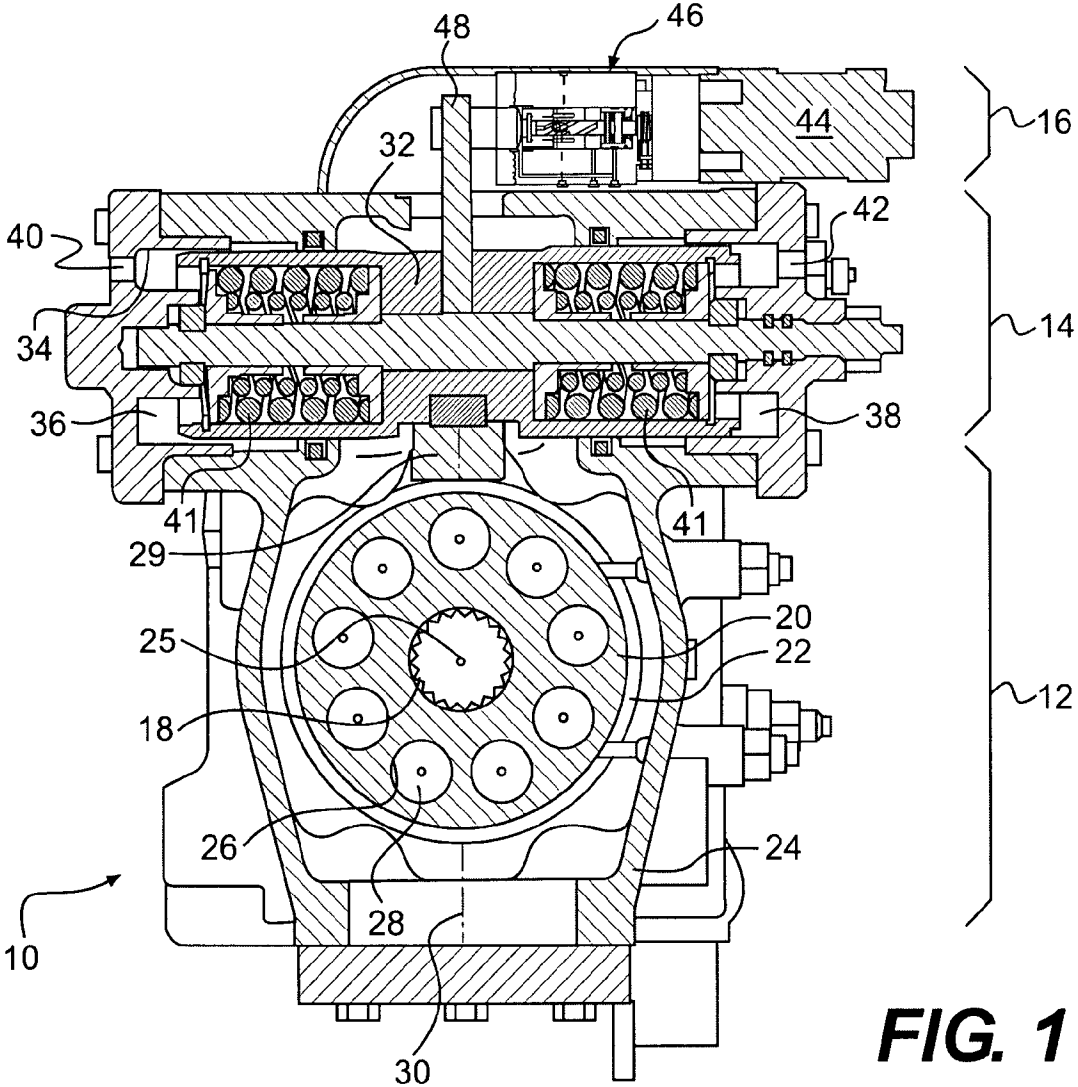
FIG. 1 is a schematic and diagrammatic illustration of an exemplary disclosed axial piston device.

FIG. 1 illustrates an exemplary axial piston device 10. In one embodiment, axial piston device 10 may be a pump that is mechanically driven to produce a flow of pressurized fluid. In another embodiment, axial piston device 10 may be a motor that receives a flow of pressurized fluid and responsively produces a mechanical output. In either embodiment, axial piston device 10 may include at least three main portions that cooperate to covert power, either from hydraulic to mechanical, or from mechanical to hydraulic. In particular, axial piston device 10 may included a pumping portion 12, a regulating portion 14, and a control portion 16. In example, regulating portion 14 and control portion 16 may, together, form an actuator that affects operation of pumping portion 12.

Pumping portion 12 may include a power transfer shaft 18, a body 20, and a tiltable plate 22. Power transfer shaft 18 may be connected to either receive power (e.g., in the pump embodiment), or to output power (e.g., in the motor embodiment). Power transfer shaft 18 may be connected to one of body 20 or plate 22 to rigidly rotate therewith. That is, body 20 may rotate relative to plate 22 (it is contemplated that either one of body 20 or plate 22 may rotate, while the other remains substantially stationary), and power transfer shaft 18 may be rigidly connected to the rotating component to receive or output mechanical power.

Body 20 may be disposed within a housing 24 and generally aligned with a central longitudinal axis 25 of power transfer shaft 18. Body 20 may include a plurality of bores 26 annularly disposed about central longitudinal axis 25 and angularly spaced at substantially equal intervals around a periphery of body 20. In one embodiment, body 20 may include nine bores 26. A pump piston 28 may be slidably disposed within each bore 26 and biased into engagement with a driving surface of plate 22. Each pump piston 28 may reciprocate within its associated bore 26 to produce a pumping action as body 20 rotates relative to plate 22 (e.g., in the pump embodiment) or may be forced from its associated bore 26 by expanding fluid to produce a mechanical rotation of power transfer shaft 18 (e.g., in the motor embodiment). Thus, each bore/pump piston pairing may at least partially define a pumping chamber.

Plate 22 may be situated within a cradle 29 that is supported by housing 24, and selectively tilted about a plate axis 30 to vary an inclination thereof relative to central longitudinal axis 25. When plate 22 is inclined and rotates relative to body 20, the driving surface of plate 22 may move each pump piston 28 through a reciprocating motion within each bore 26. When pump pistons 28 are retracting from bore 26, fluid may be allowed to enter bore 26. When pump pistons 28 are moving into bores 26 under the force imparted by plate 22, pump pistons 28 may force the fluid from bores 26. In this manner, the inclination of plate 22 relative to body 20 may be directly related to a displacement of pump pistons 28 within bores 26.

Regulating portion 14 may include components configured to affect the tilting of plate 22. Specifically, regulating portion 14 may embody a hydraulic cylinder having a control piston 32 disposed within a tube 34 to form a first pressure chamber 36 and a second pressure chamber 38. Control piston 32 may be rigidly connected to an arm of cradle 29 that projects away from plate axis 30. In this configuration, an axial movement of control piston 32 within tube 34 may result in a tilting of cradle 29 and plate 22 about plate axis 30.

First and second pressure chambers 36, 38 may be selectively supplied with pressurized fluid and drained of the pressurized fluid to cause control piston 32 to displace within tube 34. First pressure chamber 36 may be supplied with pressurized fluid or drained of the fluid by way of a first chamber port 40, while second pressure chamber 38 may be supplied with pressurized fluid or drained of the fluid by way of a second chamber port 42. When first pressure chamber 36 is supplied with pressurized fluid and second pressure chamber 38 is drained of fluid, control piston 32 may translate in a first direction toward second pressure chamber 38. In contrast, when second pressure chamber 38 is supplied with pressurized fluid and first pressure chamber 36 is drained of fluid, control piston 32 may translate in a second direction toward first pressure chamber 36.

As control piston 32 translates in the first direction, the inclination of plate 22 may increase until a maximum displacement of pump pistons 28 is achieved. In contrast, as control piston 32 translates in the second direction, the inclination of plate 22 may decrease until a minimum displacement of pump pistons 28 is achieved. In one example, the minimum displacement may be about zero such that substantially no conversion of power is achieved. Control piston 32 may be biased toward a neutral position (shown in FIG. 1) about midway between the minimum and maximum displacement positions by way of one or more return springs 41. It is contemplated, however, that control piston may alternatively be biased toward the minimum displacement position, if desired.

Control portion 16 may include components that regulate the filling and draining of first and second pressure chambers 36, 38 to thereby vary the displacement of pumping portion 12. In particular, control portion 16 may include a motor 44 situated to rotate a valve 46, and a feedback mechanism 48 having an arm operatively connected to linearly move valve 46. As motor 44 rotates valve 46 in a first direction, pressurized fluid may be directed to first pressure chamber 36, and second pressure chamber 38 may be drained of fluid. As motor 44 rotates valve 46 in a second direction opposite the first, pressurized fluid may be directed to second pressure chamber 38, and first pressure chamber 36 may be drained of fluid. When a desired displacement of pumping portion 12 has been achieved (i.e., a desired tilt angle of plate 22 has been achieved), feedback mechanism 48 may move to inhibit fluid flow through valve 46.

Figure 2:
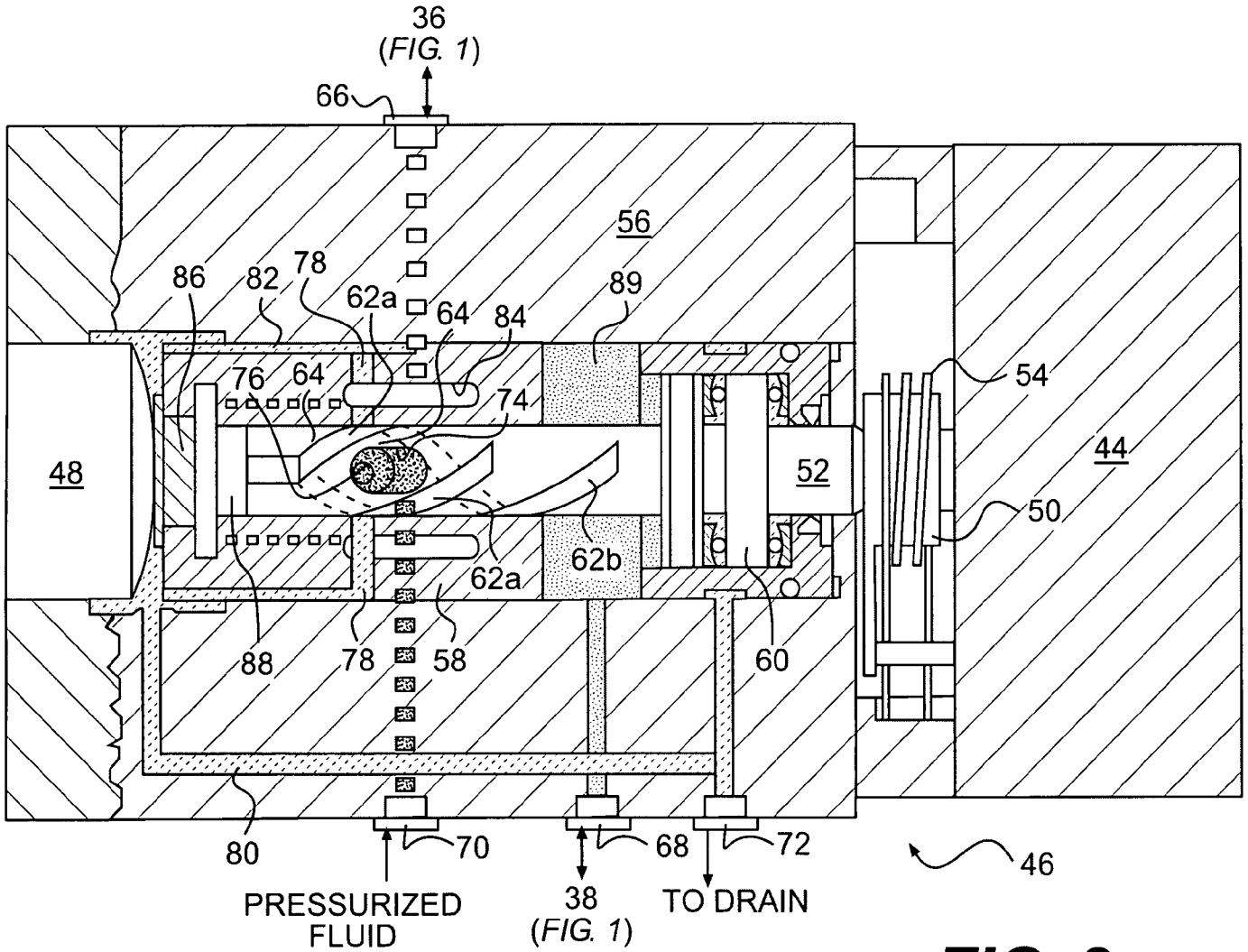
FIG. 2 is a cutaway view illustration of an exemplary disclosed actuator that may be used with the axial piston device of FIG. 1.

Movement of valve 46 may be controlled by motor 44 in a step-wise manner. Specifically, as shown in FIG. 2, motor 44 may be an electrical stepper-type motor connected to valve 46 by way of a coupling 50 (e.g., an elastic coupling), such that a valve element 52 of valve 46 may be rotated through a discrete angular displacement via motor 44. According to another example (not shown) a gear assembly, for example, a reduction gear assembly, may be provided between motor 44 and valve element 52, if desired. In response to a command for a change in pump piston displacement, motor 44 may be energized to rotate valve element 52 away from a neutral position by an amount that results in the commanded displacement change. According to some embodiments, a return mechanism 54 may be associated with coupling 50 and configured to return valve element 52 to the neutral position upon loss of power to motor 44. In one example, return mechanism 54 may include a torsional spring.

In one embodiment, valve 46 may be a cartridge type valve having valve element 52 disposed within a stationary cage 56, and a sleeve 58 that receives one end of valve element 52. A bearing member 60 may be situated in one end of cage 56 to rotatably support valve element 52. Sleeve 58 may be slidingly disposed within an opposing end of cage 56 and maintained in engagement with feedback mechanism 48 by way of fluid pressure. It is contemplated that cage 56 may be connected to or otherwise be an integral part of housing 24, if desired.

Valve element 52 may include a plurality of spiral grooves 62 defining one or more spiral lands 64 between the grooves. For example, a first spiral groove 62*a* may be located on one side of valve element 52, while a second spiral groove 62*b* may be located on a diametrically opposing side of valve element 52. Spiral grooves 62*a,b* are shown in FIG. 2 on a front side of valve element 52 in solid lines, and represented by phantom lines on a back side of valve element 52. First and second spiral grooves 62*a,b* may start and end at different axial locations along valve element 52 such that first and second spiral grooves fluidly communicate with opposing ends of valve element 52. Specifically, first spiral groove 62*a* may fluidly communicate with a sleeve-engaged end of valve element 52, while second spiral groove 62*b* may fluidly communicate with an opposing motor-engaged end of valve element 52.

Cage 56 may include a plurality of ports selectively opened and closed by movement of valve element 52 and sleeve 58 to control fluid flow through axial piston device 10. In particular, cage 56 may include a first cage port 66 in fluid communication with first pressure chamber 36, a second cage port 68 in fluid communication with second pressure chamber 38, a third cage port 70 in fluid communication with a supply of pressurized fluid (not shown), and a fourth cage port 72 in fluid communication with a low pressure drain (not shown). In one example, the supply of pressurized fluid is received from axial piston device 10. In another example, a dedicated pilot source provides the supply of pressurized fluid.

When first cage port 66 is fluidly connected to third cage port 70, and second cage port 68 is fluidly connected to fourth cage port 72, control piston 32 may move toward second pressure chamber 38 to increase the displacement of pump pistons 28. When second cage port 68 is fluidly connected to third cage port 70, and first cage port 66 is fluidly connected to fourth cage port 72, control piston 32 may move toward first pressure chamber 36 to decrease the displacement of pump pistons 28. First cage port 66 may be continuously fluidly communicated with first spiral groove 62*a* via the sleeve-engaged end of valve element 52, while second cage port 68 may be continuously fluidly communicated with second spiral groove 62*b* via the motor-engaged end of valve element 52. A longitudinally extending recess 74 may be located within an internal surface of cage 56 at third cage port 70, such that axial movement of sleeve 58 relative to cage 56 may be facilitated with minimal reduction in fluid communication.

Sleeve 58 may selectively allow or inhibit fluid flow between first and second cage ports 66, 68 and third and fourth cage ports 70, 72. In particular, sleeve 58 may include a first sleeve port 76 and a second sleeve port 78. In one embodiment, sleeve 58 may include a first set of diametrically opposed sleeve ports 76, and a second set of diametrically opposed sleeve ports 78. First sleeve port(s) 76 may be associated with third cage port 70 (i.e., in continuous fluid communication with the supply of pressurized fluid via third cage port 70 and recess 74), while second sleeve port(s) 78 may be associated with fourth cage port 72 (i.e., in continuous fluid communication with the low pressure drain via fourth cage port 72, a passage 80, and a clearance 82 between cage 56 and sleeve 58 at one end). Sleeve 58 may also include one or more passages 84 that facilitate continuous fluid communication between first cage port 66 and first spiral groove 62*a*. A plug 86 may be located to close off one end of sleeve 58, thereby creating a chamber 88 at the sleeve-engaged end of valve element 52 that fluidly communicates passages 84 with first spiral groove 62*a*. A chamber 89 at the opposing motor-engaged end of valve element 52 may provide for continuous fluid communication between second cage port 68 and second spiral groove 62*b*.

Feedback mechanism 48 may be rigidly connected to control piston 32 and engaged with plug 86. In this configuration, as the tilt angle of plate 22 (referring to FIG. 1) is adjusted by control piston 32 to a desired angle, feedback mechanism 48 may press against sleeve 58 by way of plug 86. As feedback mechanism 48 presses against sleeve 58, sleeve 58 may linearly translate relative to valve element 52 and inhibit fluid communication between first and second cage ports 66, 68 and third and forth cage ports 70, 72, thereby halting movement of control piston 32 and maintaining a desired tilt angle of plate 22.

INDUSTRIAL APPLICABILITY

The disclosed axial piston device may find potential application in any fluid circuit where fluid energy is converted to mechanical energy or visa versa. The disclosed axial piston device may provide accurate displacement control through the use of a rotary actuator. Operation of axial piston device 10 will now be described.

During operation as a pump, power transfer shaft 18 may be rotated, for example by a combustion engine, to produce a flow of pressurized fluid. In this application, as power transfer shaft 18 is rotated, body 20 and associated pump pistons 28 may rotate relative to plate 22. When tilted relative to central longitudinal axis 25, plate 22 may force pump pistons 28 to reciprocate within their respective bores 26 (i.e., to mechanically reduce the volume of the pumping chambers) and discharge fluid from bores 26 at a flow rate and/or a pressure related to the tilt angle of plate 22.

During operation as a motor, pressurized fluid may be received by axial piston device 10 and converted into a mechanical rotation of power transfer shaft 18. In this application, as the pressurized fluid enters axial piston device 10, it may be directed into bores 26, where it urges pump pistons 28 to extend from bores 26. As pump pistons 28 extend from bores 26, they may press against plate 22. When tilted relative to central longitudinal axis 25, plate 22 may rotate relative to body 20 in response to the pressure from pump pistons 28 at a speed and/or force related to the tilt angle of plate 22.

Motor 44 may rotate valve element 52 to adjust the tilt angle of plate 22. For example, as motor 44 rotates valve element 52 in the first direction (i.e., a clockwise direction when viewed from a motor-engaged end of valve element 52), first spiral groove 62*a* may move to align with first sleeve port 76 and thereby communicate pressurized fluid from third cage port 70 with first pressure chamber 36 by way of first sleeve port 76, recess 74, chamber 88, passage 84, and first cage port 66. Substantially simultaneously, second spiral groove 62*b* may move to align with second sleeve port 78 and thereby drain fluid from within second pressure chamber 38 by way of second cage port 68, chamber 89, second sleeve port 78, clearance 82, and passage 80, and fourth cage port 72. As long as these communications are maintained, control piston 32 may move to decrease the tilt angle of plate 22.

The fluid communications associated with the clockwise rotation of motor 44 may be maintained until sleeve 58 is moved by feedback mechanism 48 an axial distance away from motor 44 related to a desired tilt angle. At the desired tilt angle, first and second sleeve ports 76, 78 may no longer be aligned with first and second spiral grooves 62*a, b*, (i.e., lands 64 may instead be aligned with and substantially block first and second sleeve ports 76, 78) and continued movement of control piston 32 may thus be inhibited.

As motor 44 rotates valve element 52 in the second direction (i.e., a counter-clockwise direction when viewed from the motor-engaged end of valve element 52), first spiral groove 62*a* may move to fluidly communicate first pressure chamber 36 with fourth cage port 72 by way of first cage port 66, passage 84, chamber 88, second sleeve port 78, clearance 82, and passage 80 to drain second pressure chamber 38. Substantially simultaneously, second groove 62*b* may move to align with first sleeve port 76 and thereby communicate pressurized fluid from third cage port 70 with second pressure chamber 38 by way of first sleeve port 76, recess 74, chamber 89, and second cage port 68. As long as these communications are maintained, control piston 32 may move to increase the tilt angle of plate 22.

These communications associated with the counter-clockwise rotation of motor 44 may be maintained until sleeve 58 is moved by feedback mechanism 48 an axial distance toward motor 44 related to a desired tilt angle. At the desired tilt angle, first and second sleeve ports 76, 78 may no longer be aligned with first and second spiral grooves 62*a, b*, and continued movement of control piston 32 may be inhibited.

In the disclosed configuration, an angular rotation of motor 44 may be directly related to axial movement of spiral grooves 62*a,b* away from first and second sleeve ports 76, 78. As a result, an angular rotation of motor 44 may be related to an axial distance that sleeve 58 must move to block first and second sleeve ports 76, 78 and thereby halt movement of control piston 32 (i.e., maintain a particular tilt angle of plate 22). Thus, a particular angular rotation of motor 44 can be directly related to a known tilt angle of plate 22.

Several benefits may be provided by the disclosed axial piston device. For example, because the disclosed axial piston device utilizes a stepper type motor, precise control over valve movement and, subsequently, pump piston displacement, may be ensured without requiring overly tight control over the current applied to motor 44. And, the stepping function of motor 44 may help ensure continued precision as axial piston device 10 ages or is used under varying conditions. Further, because the disclosed axial piston device does not rely on the flexing of structural members, its durability and responsiveness may be high. In addition, the rotational movement of valve element 52 may reduce the affect of flow forces on displacement accuracy.

It will be apparent to those skilled in the art that various modifications and variations can be made in the axial piston device of the present disclosure without departing from the scope of the disclosure. Other embodiments will be apparent to those skilled in the art from consideration of the specification and practice of the axial piston device disclosed herein. It is intended that the specification and examples be considered as exemplary only, with a true scope of the disclosure being indicated by the following claims and their equivalents.

What is claimed is:

1. An axial piston device, comprising:

a body defining at least one bore and having a central axis;

a pump piston disposed within the at least one bore to at least partially define a pumping chamber;

a tiltable plate biased into engagement with the pump piston; and an actuator configured to selectively tilt the plate relative to the central axis of the body to thereby vary a displacement of the pump piston within the at least one bore, the actuator including:

a control piston operatively connected to move the tiltable plate; a rotary motor; and a valve driven by the rotary motor to control fluid communication between the control piston and a source of pressurized fluid to move the control piston, wherein the valve includes a valve element having a first spiral groove in fluid communication with a first end of the control piston, and a second spiral groove in fluid communication with a second end of the control piston.

2. The axial piston device of claim 1, wherein the rotary motor is electrically driven.

3. The axial piston device of claim 2, wherein the rotary motor is a stepper motor.

4. The axial piston device of claim 1, wherein the pump piston is driven by pressurized fluid within the pumping chamber to generate a mechanical output.

5. The axial piston device of claim 1, wherein the pump piston is mechanically driven to pressurize and expel fluid from the pumping chamber.

6. The axial piston device of claim 1, further including a mechanical feedback mechanism configured to inhibit fluid communication between the control piston and the source of pressurized fluid when a desired angle of the tiltable plate has been achieved.

7. The axial piston device of claim 6, wherein the mechanical feedback mechanism includes an arm operatively connected between the tiltable plate and the valve.

8. The axial piston device of claim 7, wherein the valve includes:

a cage having the valve element disposed therein, the cage having a first cage port in fluid communication with the source of pressurized fluid, and a second cage port in fluid communication with a low pressure drain; and a sleeve connected to the arm and configured to receive an end of the valve element, the sleeve having a first sleeve port configured to selectively communicate one of the first and second spiral grooves with the first cage port, and a second sleeve port configured to selectively communicate one of the first and second spiral grooves with the second cage port.

9. The axial piston device of claim 8, wherein:

a rotation of the valve element in a first direction fluidly communicates the first cage port with the first spiral groove via the first sleeve port, and the second cage port with the second spiral groove via the second sleeve port; and a rotation of the valve element in a second direction fluidly communicates the first cage port with the second spiral groove via the first sleeve port, and the second cage port with the first spiral groove via the second sleeve port.

10. The axial piston device of claim 9, wherein translation of the sleeve inhibits fluid communication between the first and second cage ports and the first and second spiral grooves.

11. The axial piston device of claim 8, wherein the first and second spiral grooves are defined by an exterior surface of the valve element.

12. The axial piston device of claim 1, further including a torsional spring configured to bias the valve toward a neutral position.

13. A method of converting power, comprising:

directing fluid into a pumping chamber mechanically reducing a volume of the pumping chamber to pressurize and expel the fluid from the pumping chamber;

rotating a valve element to hydraulically adjust an amount of mechanical reduction; and continuously biasing the valve element toward a neutral position wherein an end of the valve element is received in a sleeve, and wherein rotating the valve element provides fluid communication between a spiral groove of the valve element and a port of the sleeve.

14. The method of claim 13, wherein rotating the valve element is accomplished electrically in a step-wise manner.

15. The method of claim 13, further including directing a translational mechanical feedback to the valve element indicative of an achieved adjustment amount.

16. The method of claim 15, wherein the translational mechanical feedback blocks fluid passage through the valve element.

17. The method of claim 13, wherein:

a rotation of the valve element in a first direction results in an increase in the mechanical reduction; and a rotation of the valve element in a second direction results in a decrease in the mechanical reduction.

18. A method of converting power, comprising:

directing pressurized fluid into a pumping chamber;

expanding the pressurized fluid within the pumping chamber to generate a mechanical output; and rotating a valve element to hydraulically adjust an amount of expansion, wherein an end of the valve element is received in a sleeve, and wherein rotating the valve element provides fluid communication between a spiral groove of the valve element and a port of the sleeve.

19. The method of claim 18, further including directing a translational mechanical feedback to the valve element indicative of an achieved adjustment amount, wherein the translational mechanical feedback blocks fluid passage through the valve element.

* * * * *